US005718604A

United States Patent [19]

Conorich et al.

[11] Patent Number: 5,718,604

[45] Date of Patent: Feb. 17, 1998

[54] PATCH CORD CONNECTION SYSTEM

[75] Inventors: Theodore Alan Conorich, Morris County; Michael Gregory German, Secaucus, both of N.J.

[73] Assignee: Lucent Technologies Inc., Murray Hill, N.J.

[21] Appl. No.: 615,647

[22] Filed: Mar. 13, 1996

[51] Int. Cl.[6] ..... H01R 4/24; H01R 4/26; H01R 11/20

[52] U.S. Cl. ..... 439/501; 439/49; 439/404; 439/696

[58] Field of Search ..... 439/692, 695, 439/696, 404, 501, 49, 709, 717

[56] References Cited

U.S. PATENT DOCUMENTS

| | | | |
|---|---|---|---|
| 3,725,848 | 4/1973 | Davidson | 439/501 |
| 3,798,587 | 5/1974 | Ellis, Jr. et al. | 439/97 |
| 4,153,326 | 5/1979 | Frantz et al. | 439/404 |
| 4,431,249 | 2/1984 | Frantz et al. | 439/404 |
| 4,610,880 | 9/1986 | Brey | 439/49 |
| 4,797,124 | 1/1989 | Beaulieu et al. | 439/719 |
| 4,861,283 | 8/1989 | Buaulieu et al. | 439/922 |
| 5,219,304 | 6/1993 | Lin | 439/696 |

*Primary Examiner*—Gary F. Paumen
*Assistant Examiner*—Katrina Davis
*Attorney, Agent, or Firm*—Lester H. Birnbaum

[57] ABSTRACT

Disclosed is an electrical connection system including connecting blocks and patch cord connectors where the patch cords are directed toward, rather than away from, the connecting blocks. Troughs are included between adjacent rows of connecting blocks to accommodate the patch cords from the patch cord connectors connected to one of the rows.

10 Claims, 5 Drawing Sheets

PATCH CORD CONNECTION SYSTEM

FIELD OF THE INVENTION

This invention relates to electrical connection systems employing patch cord connectors.

BACKGROUND OF THE INVENTION

Electrical connection systems, such as the 110-type connecting system, are used throughout the telecommunications industry in order to interconnect corresponding wires in two sets of wires. In the 110-type system, the first set of wires is coupled to an index strip which includes a row of teeth so that each wire is secured between adjacent teeth. A connector block which includes contacts having insulation displacement portions on two opposite ends is brought down on the index strip to electrically contact the set of wires. The opposite ends of the contacts are enclosed by another set of teeth. Individual wires from the second set may be inserted into the insulation displacement portions between the teeth to make electrical contact with the first set of wires. Alternatively, the second set of wires may be electrically connected to a patch cord connector which includes conductive blades for insertion into the insulation displacement portions. (See, for example, U.S. Pat. No. 3,798,587 issued to Ellis, It. et al.)

In cases of dense arrays of connectors, the patch cord connectors presented a rather unruly appearance, and it was often difficult to locate a particular patch cord connector when it was necessary to alter the connection.

It is desirable, therefore, to have an electrical connection system with patch cord connectors possessing a neat appearance and permitting easy identification.

SUMMARY OF THE INVENTION

The invention, in accordance with one aspect, is a patch cord connector including a housing having a front surface for mating with a connector block. The housing further includes a passageway for accommodating a patch cord so that the cord is directed toward the front surface.

In accordance with another aspect, the invention is an electrical connection system comprising a plurality of patch cord connectors and a plurality of rows of connector blocks which are electrically connectable to the patch cord connectors. The patch cord connectors each include a housing having a front surface for mating with a corresponding connector block, and a passageway for accommodating a patch cord so that the cord is directed toward the front surface. A deep trough is included between each row of the connector blocks, the trough being of a sufficient size to include therein all the patch cords from connectors which are mated with connector blocks in one of said rows.

BRIEF DESCRIPTION OF THE FIGURES

These and other features of the invention are delineated in detail in the following description. In the drawing.

It will be appreciated that, for purposes of illustration, these figures are not necessarily drawn to scale.

DETAILED DESCRIPTION

Figure 1:
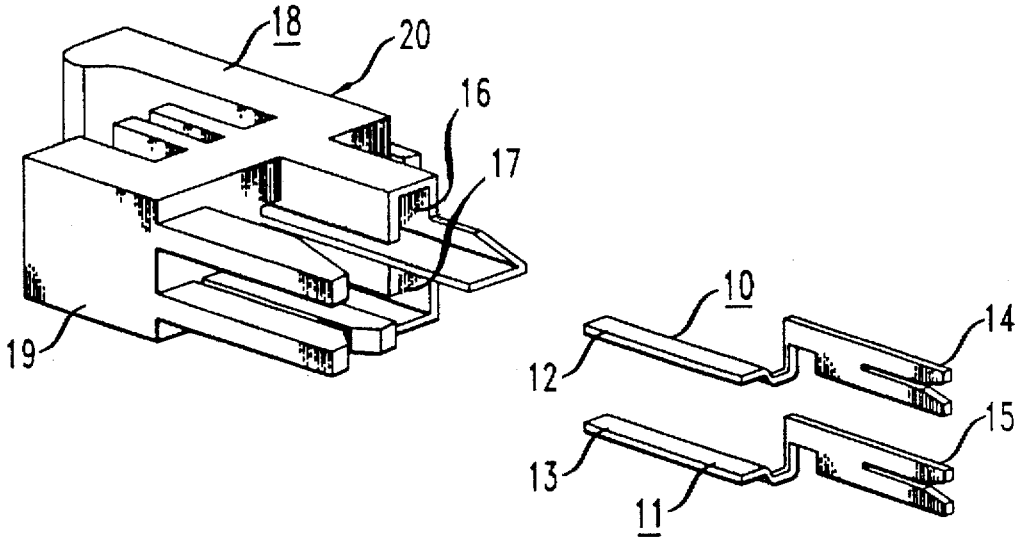
FIG. 1 is an exploded view of a portion of a patch cord connector according to one embodiment of the invention.

Referring now to the drawings, in which like reference numerals identify similar or identical elements, FIG. 1 illustrates in an exploded view a portion of the patch cord connector in accordance with one embodiment of the invention. A pair of contacts, 10 and 11, each have on one end a flat, horizontal blade portion, 12 and 13, respectively, and a vertical insulation displacement portion, 14 and 15, on the opposite end. The insulation displacement portions, 14 and 15, are of the standard type which pierce the insulation surrounding a conductive wire in order to make electrical contact therewith. Each contact, 10 and 11, is inserted into a corresponding slot, 16 and 17, in a first insulating housing, 18, which has side surfaces, 19 and 20, and is typically made of plastic. As further illustrated in the right hand portion of FIG. 2, where the housing, 18, is rotated 180 degrees, the contacts are inserted so that the blade portions, e.g., 13, fit within respective slots at a front portion defined by protrusions, e.g., 21 and 22, from the side surfaces, 19 and 20. The insulation displacement portions, e.g., 15, protrude from a rear portion of the housing, 18. As further illustrated in FIG. 2, one of the side surfaces, 20, of the first housing, 18, includes a semi-cylindrical member, 23, which is typically integrally molded with the housing, 18. The semi-cylindrical member, 23, includes flanged edges, 24 and 25.

Figure 2:
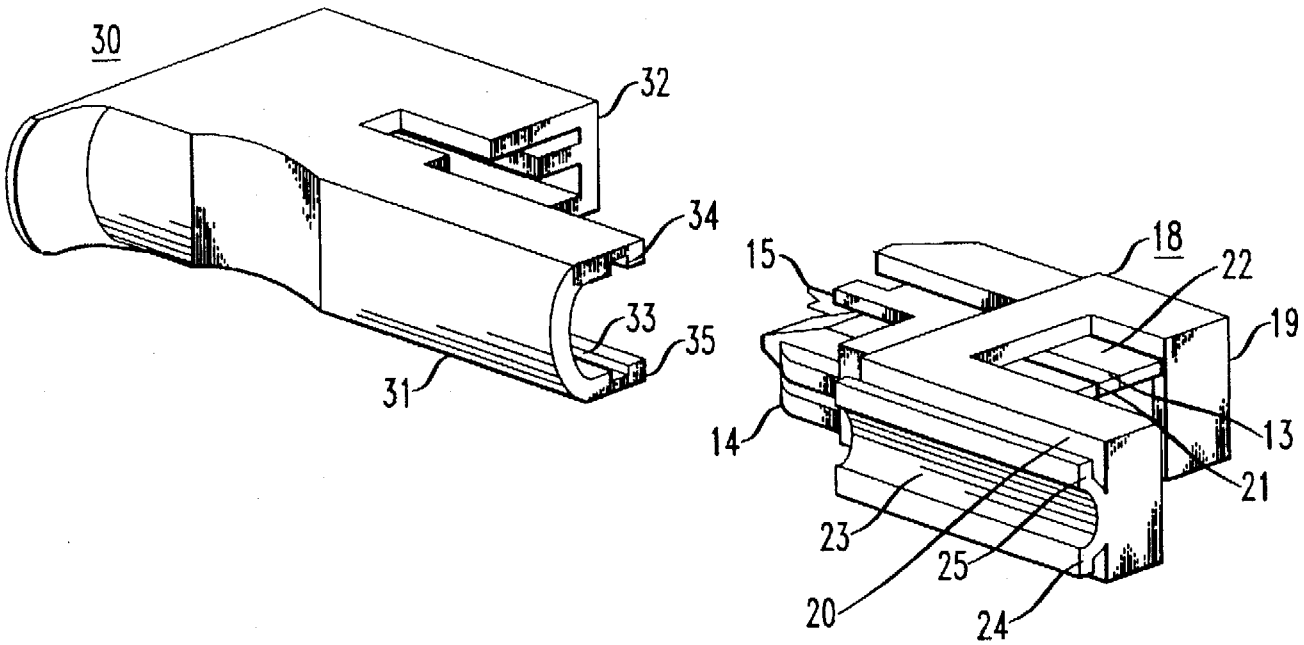
FIG. 2 is an exploded view of a further portion of the connector of FIG. 1.

Also shown in FIG. 2 is a second insulating housing, 30, also made of plastic, which includes two side surfaces, 31 and 32. One side surface, 32, is essentially flat, while the opposite side surface, 31, is molded into a semi-cylindrical inner surface, 33, and a pair of grooves, 34 and 35, on opposing edges.

Figure 4:
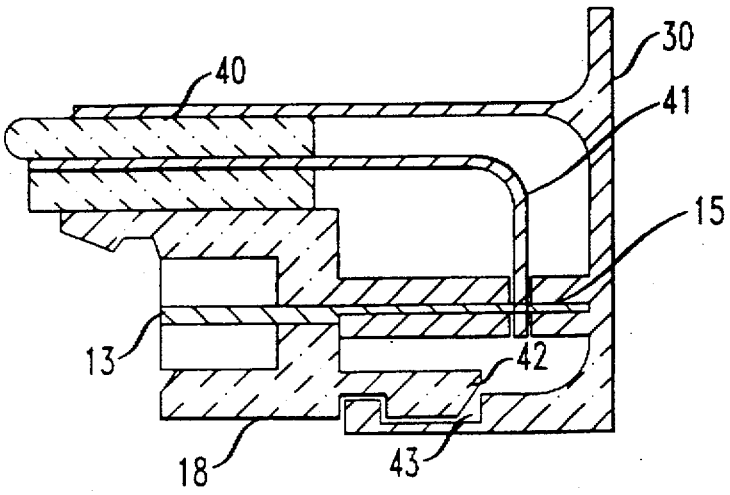
FIG. 4 is a cross sectional view of the connector of FIG. 3.
Figure 3:
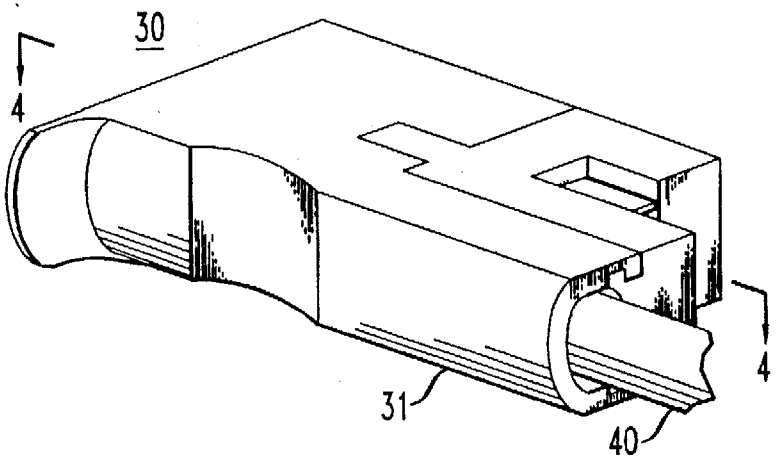
FIG. 3 is a perspective view of an essentially complete connector in accordance with the same embodiment of the invention.

The two housings, 30 and 18, are assembled to form a patch cord connector, as illustrated in the perspective view of FIG. 3 and the cross-sectional view of FIG. 4 which is taken along line 4—4 of FIG. 3. Prior to assembly, a patch cord, 40, is prepared by stripping away a portion of its insulating jacket to expose the two wires therein, only one of which, 41, is visible in FIG. 4. The wires are terminated to insulation displacement portions 14 and 15, and the patch cord, 40, is then placed into the semi-cylindrical member, 23, of the first housing, 18. The flanged edges, 24 and 25, of the first housing are then inserted into the grooves, 34 and 35, of the second housing. The second housing, 30, is slid toward the rear of the first housing, 18, until a latch, 42, in the first housing, 18, engages an aperture, 43, in the second housing, 30. At this point, the first and second housings are securely joined. Further, the insulation displacement portions, e.g., 15, of the two contacts, e.g., 11, make physical and electrical contact with respective wires, e.g., 41, in the patch cord, 40. The two semi-cylindrical members, 23 and 33, of the two housings together form a cylindrical passageway so that the patch cord, 40, extends out of the front portion of the patch cord connector.

Figure 5:
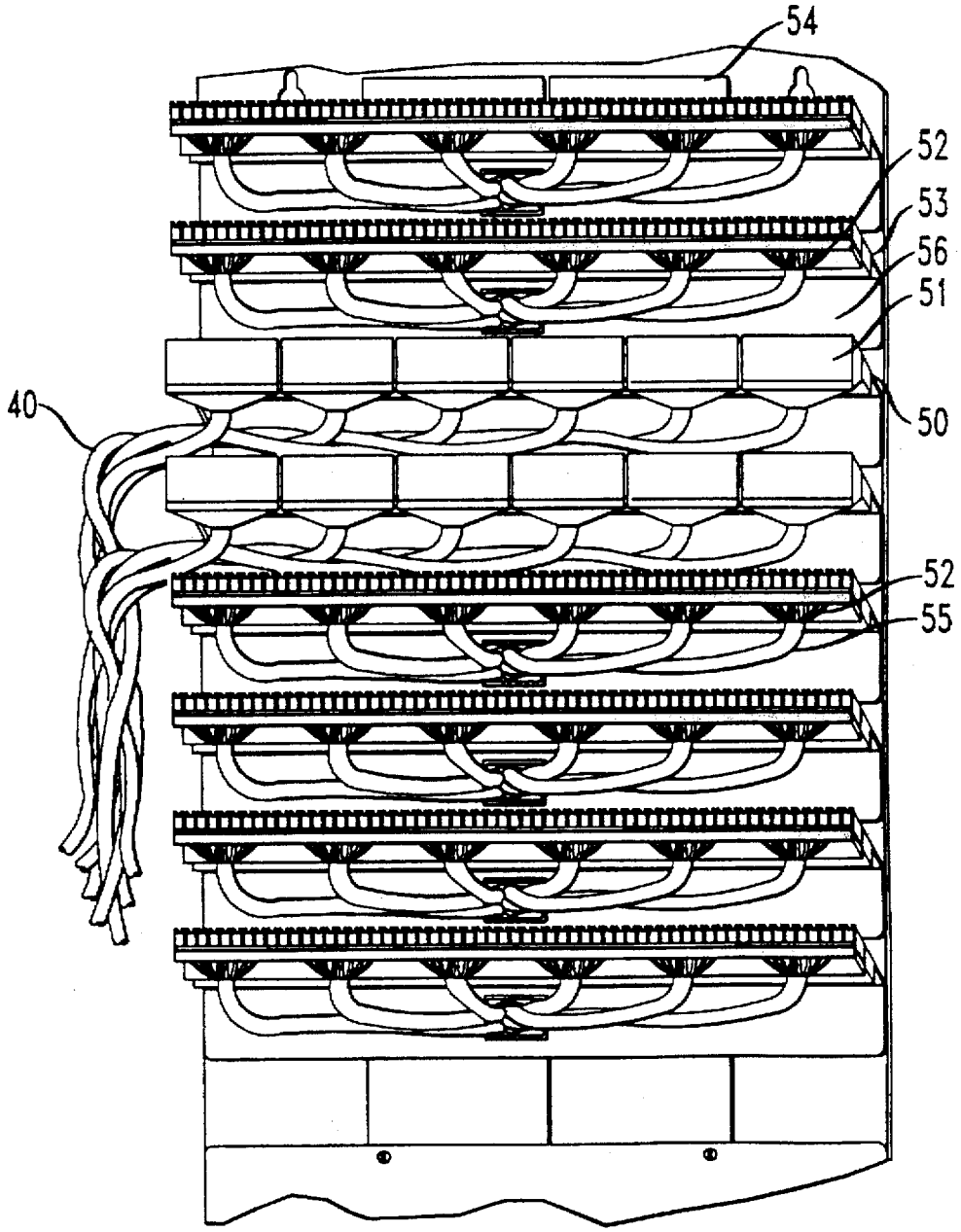
FIG. 5 is a perspective view of a connection system in accordance with an embodiment of the invention.

The resulting patch cord connector can be applied to a connection system as illustrated in FIG. 5. The connecting blocks, e.g., 50, to which the patch cord connectors, e.g., 51, are mated in this example, are 110-type blocks which are arranged in rows as shown. As known in the art, the 110-type connector blocks each include a row of contacts (not shown) with insulation displacement portions on both ends which electrically connect to a set of wires, e.g., 52, on one end and to the blade portion, e.g., 13, of a patch cord connector on its opposite end. The connecting block contacts are surrounded by an insulating housing which includes a row of teeth on the ends which contact the patch cord connector such that the blade portions of the patch cord connector fit within slits separating the teeth to make electrical contact with the contacts of the connecting block. (See also, U.S. Patent Application of Baker et al., filed on an even date herewith.) Each connecting block, e.g., 50, is mounted to a bracket, e.g., 53, which are in turn mounted to a beam, 54. The spacing between the rows of connecting blocks forms troughs each of which is large enough, in this example, 3 cm wide and 8.9 cm deep, in order to accommodate all the cables, e.g., 55, including the sets of wires, e.g., 52 for that row as well as all the patch cords, e.g., 40 of FIGS. 3 and 4, from the connectors coupled to that row. If desired, all the patch cords can exit one end of the row and all the cables housing the wires can exit the opposite end of the row. Typically the depth of the trough, will be measured from the wall, 56, of the bracket, 53, to the end of the connecting block, 50, within the range 6.3–10 cm.

Thus, it will be appreciated that since the patch cords, e.g., 40, are directed toward the connecting block, 50, rather than away from the block, the connection system provides a much neater appearance and makes it easier for the craftsperson to locate a particular patch cord connector for disconnection or a particular part of the connector block for connection.

Figure 6:
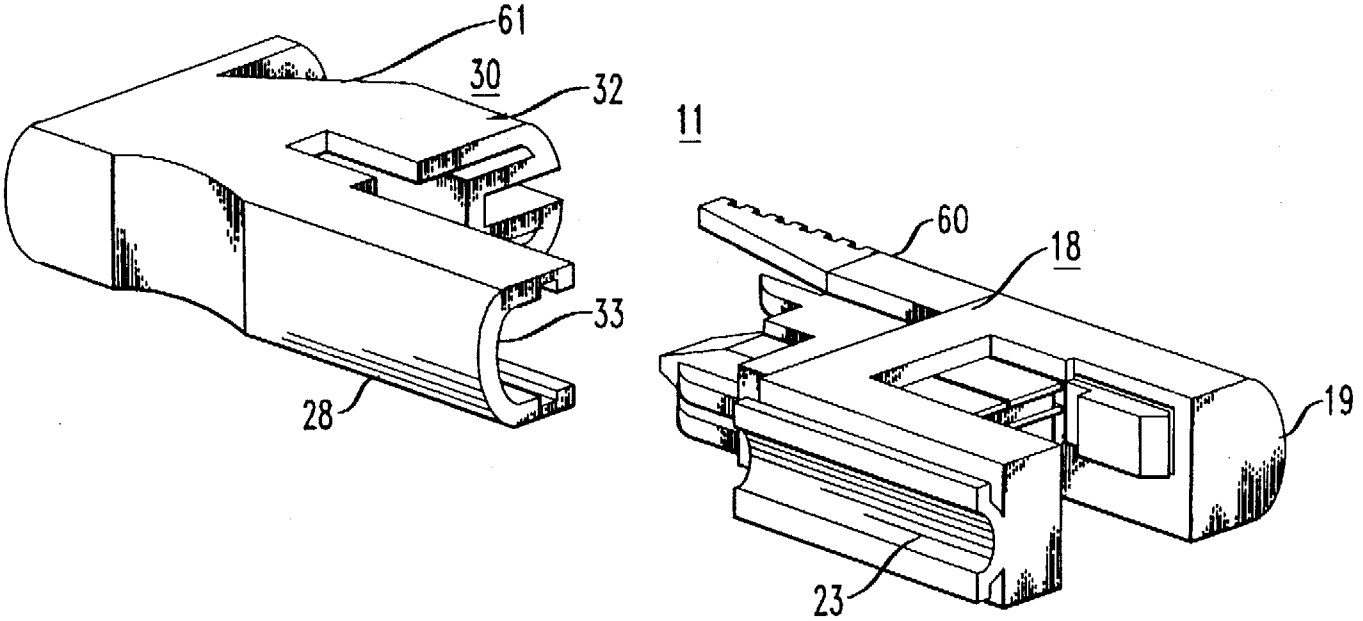
FIG. 6 is a perspective view of a patch cord connector in accordance with a further embodiment of the invention.

FIG. 6 illustrates a patch cord connector in accordance with another embodiment where the first housing, 18, includes on one end surface, 19, a cantilever latch, 60, which latches onto a portion of the connector block, 50. (See, U.S. Patent Application of Baker et at., cited previously.) One end, 32, of the second housing, 30, includes an indented portion, 61, which permits operation of the handle of the cantilever latch, 60. The patch cord connector of FIG. 6 is otherwise essentially the same as that shown in FIGS. 1–4.

Figure 7:
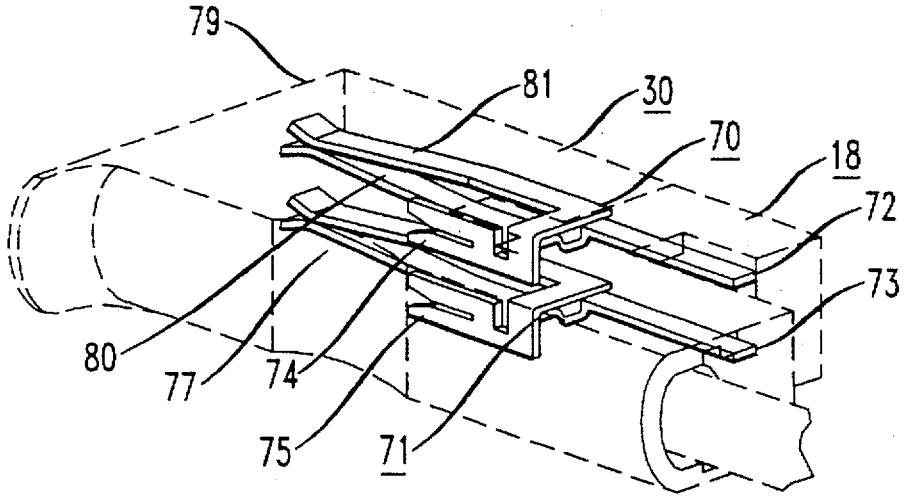
FIG. 7 is a perspective view of a portion of a patch cord connector in accordance with a further embodiment of the invention.

FIG. 7 illustrates a pair of contacts, 70 and 71, which may be used in place of the contacts, 10 and 11, of FIGS. 1–4.

Each contact, e.g., 70, 71, includes two parts, one part includes an insulation displacement portion, 74 and a tine portion 81. The second pan includes a blade portion, 72, and a tyne portion 80. The tines 80 and 81 together form a socket which can be accessed through an opening in the back surface, 79, of the connector housing, 30, which is shown in outline for illustrative purposes. Alternatively, the sockets can protrude through the back surface, 79. These sockets are capable of receiving test probes (not shown) or other types of connectors at the rear of the patch cord connector.

Various modifications of the invention will become apparent to those skilled in the art. For example, although only pairs of contacts are shown in the patch cord connector, it will be understood that any plurality of contacts can be included within a single patch cord connector.

What is claimed is:

1. A patch cord connector comprising:

a housing having a front surface which includes contacts which are electrically connectable to a connecting block; and a passageway defined by said housing for accommodating a patch cord electrically connected to the contacts so that the cord passes through the front surface.

2. A connector according to claim 1 further comprising at least two contacts mounted within the housing, each contact including a blade portion at one end positioned at the front surface, and an insulation displacement portion positioned near a rear surface of the housing.

3. A connector according to claim 2 wherein the cord comprises a plurality of wires, and the insulation displacement portions of the contacts each make electrical contact with a corresponding wire.

4. A connector according to claim 1 wherein the passageway is formed for the cord by first and second sections of the housing, each section including a semi-cylindrical surface, the sections together forming the passageway, the passageway being cylindrical.

5. A connector according to claim 4 wherein said first surface varies from said second surface, one of said surfaces including a pair of flanged edges and the other of said surfaces including a pair of grooves for receiving the flanged edges.

6. An electrical connection system comprising:

a plurality of rows of connection blocks, each row being separated by a trough; and a plurality of patch cord connectors, each connector including a housing having a front surface which is electrically connectable with a corresponding connecting block, and a passageway for accommodating a patch cord so that the patch cord is directed toward the front surface, each trough being of a sufficient size to include therein all the patch cords from connectors which are mated with the connecting blocks in one of said rows.

7. A system according to claim 6 wherein the connecting blocks are of the 110-type which make electrical connection to the patch cord connectors on one end and make electrical connection to a set of wires on the opposite end.

8. A system according to claim 7 wherein the set of wires are included within cables, and each trough includes said cables as well as said patch cords.

9. A system according to claim 6 wherein each trough includes at least one open end which permits exit of the patch cords from the patch cord connectors.

10. A system according to claim 6 wherein the connecting blocks are mounted to a bracket which forms one wall of the adjacent trough.

* * * * *